US005388290A

United States Patent [19]

Shirai

[11] Patent Number: 5,388,290

[45] Date of Patent: Feb. 14, 1995

[54] BOTTOM STRUCTURE OF A BED

[75] Inventor: Kunito Shirai, Togane, Japan

[73] Assignee: Paramount Bed Company Limited, Tokyo, Japan

[21] Appl. No.: 170,714

[22] Filed: Dec. 21, 1993

[30] Foreign Application Priority Data

Dec. 25, 1992 [JP] Japan ..... 4-89069

[51] Int. Cl.[6] ..... A47C 19/00

[52] U.S. Cl. ..... 5/236.1; 5/191; 5/188; 5/613

[58] Field of Search ..... 5/613, 617, 188, 191, 5/236.1, 400, 401, 465

[56] References Cited

U.S. PATENT DOCUMENTS 4,785,487 11/1988 Toran ..... 5/618 X
5,222,263 6/1993 Magistretti ..... 5/465

FOREIGN PATENT DOCUMENTS 465443 9/1928 Germany ..... 5/236.1
51-30716 9/1976 Japan .
54-26164 8/1979 Japan .
54-37594 11/1979 Japan .

*Primary Examiner*—Michael F. Trettel
*Attorney, Agent, or Firm*—Townsend & Banta

[57] ABSTRACT

The present invention provides a bottom structure for a bed having a bottom lifting mechanism, comprising plural parallel bottom strips; each of the bottom strips being sequentially connected to allow bottom bending; and each of the bottom strips, having a tenon formed in the longitudinal axial direction of the bed on one of the faces to be face-to-face with the adjacent bottom strip, and having a mortise formed in the opposite face, so as to be loosely engaged with the tenon of the adjacent bottom strip.

5 Claims, 3 Drawing Sheets

BOTTOM STRUCTURE OF A BED

CROSS-REFERENCE TO RELATED APPLICATION

This application claims the priority of Japanese Patent Application No. 89069/1992 filed on Dec. 25, 1992, which is incorporated herein by reference,

BACKGROUND OF THE INVENTION

1. Field of the Invention

The present invention relates to a bottom structure for a bed which can be bent to a proper curvature while allowing a patient to continue feeling relaxed even though the bottom is being partially lifted.

2. Description of Related Art

Many of recent beds are equipped with a bottom lifting mechanism and various mechanisms are available. An ordinary liftable bed has a back bottom portion simply connected to a waist bottom portion. The waist bottom portion is simply connected to a leg bottom portion. When the back bottom portion is lifted, the joint between the back and waist portions acts as a pivot, (i.e. forming an actual fulcrum), while when the leg portion is lifted, the joint between the waist and leg bottom portions also acts as a pivot.

Therefore, as the back bottom portion is lifted up forming an angle, the angular space between the back and waist bottom portions near the joint is narrowed, and unless the angle fits the body of the patient in the bed, the waist, abdomen, and underside of the patient's legs are uncomfortably pressed by the mattress.

SUMMARY OF THE INVENTION

The present invention has achieved a solution to the above cited problem. The object of the present invention is to provide a bottom structure for a bed, which can be bent in appropriate curves to provide gentle curvature spaces at the bent portions of the bed so as to minimize any displeasing pressure points for the patient.

To solve the problem, the present invention provides a bottom structure for a bed having a bottom lifting mechanism, comprising plural parallel bottom strips; each of the bottom strips being sequentially connected to allow bottom bending; and each of the bottom strips, having a tenon formed in the longitudinal axial direction of the bed (direction along the long horizontal plane of the bed when the bed is completely flat on one of the faces to be face-to-face with the adjacent bottom strip, and having a mortise formed in the opposite face, so as to be loosely engaged with the tenon of the adjacent bottom strip.

The present invention also provides a bottom structure for a bed in which the tenons are formed to be relatively longer, and the mortises are formed to relatively deeper. The sequentially connected bottom strips may be thus connected more closely to each other or distant from each other allowing the length of the bed in the longitudinal direction to be adjusted.

When the bottom structure is lifted at the back and knee portions, the plural bottom strips are raised forming a gentle curve. Since the bottom strips have their tenons loosely engaged with the mortises of the adjacent bottom strips, the bottom strips form angles relative to the respectively adjacent bottom strips. Therefore, if the shape of the tenons and mortises or their intervals are changed the bending angle can be adjusted, and if the number of the bottom strips is changed, the length of the bending angle can also be adjusted. When the tenons are formed to be longer and the mortises are deep, the length of the bottom structure containing the bottom strips can be adjusted in the longitudinal direction of the bed.

Symbols:

1 Bed
2 Bottom
3 Actuator
4 Back Lifting Arm
5 Knee Lifting Arm
6 and 7 Roller
8 Bottom Strip
9 Tenon
10 Mortise
11 Tip
12 Opening
13 Mattress
14 Flexible Sheet
15 Attachment Means
16 Gap

DETAILED DESCRIPTION OF THE INVENTION

The bottom structure for a bed of the present invention is described below in reference to the attached drawings.

Figure 1:
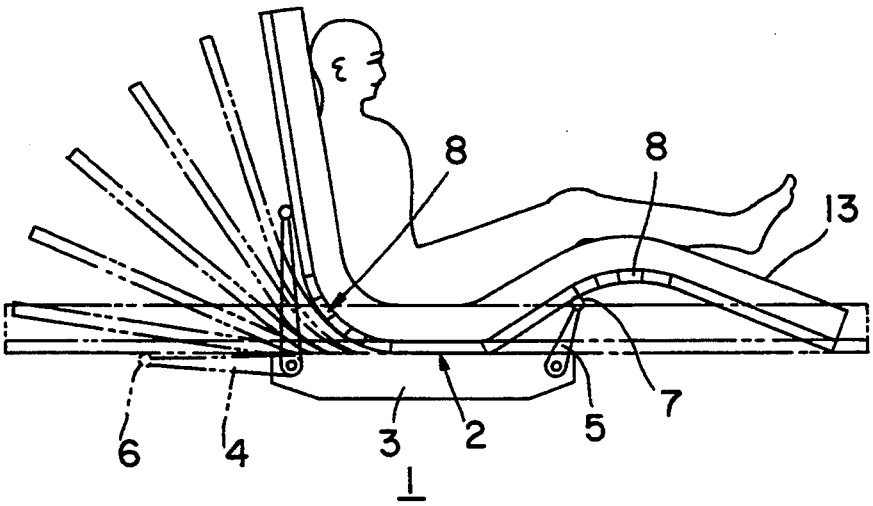
FIG. 1 is a side illustration showing the bed having the bottom structure of the present device invention.

FIG. 1 shows a bed 1 having a bottom structure of the present invention. The bed 1 can be lifted at the back and knee portions by an electric actuator 3 provided below the bottom 2. The actuator 3 is provided with back lifting arms 4 for lifting the back portion and knee lifting arms 5 for lifting the knee portion. The back lifting arms 4 contact the bottom 2 on the underside at the back portion, through rollers 6, and the knee lifting arms 5 contact the bottom 2 of the underside at the portion near the patient's knees through rollers 7.

In this bed 1, the bottom strips 8 are connected at the bendable portion between the back and waist portions of the bottom 2 and at the bendable portion corresponding to the patient's knees.

Each of the bottom strips 8 has a tenon 9 formed in the longitudinal axial direction of the bed when the bed is flat, and a mortise 10 formed in the opposite face. The mortise of each bottom strip is face-to-face with the tenon of the adjacent bottom strip. Each of the tenons 9 has a wide spread tip 11, and each of the corresponding mortises 10 has a narrowed opening 12.

The bottom strips 8 may be molded and may be either hollow or solid. They may also be made of wood.

In the bed 1 with the above bottom structure, if the actuator 3 moves so as to partially lift the bottom 2, the plural bottom strips 8 are raised to form a gentle curve. Since the bottom strips 8 have their tenons 9 loosely engaged with the mortises 10 of the adjacent bottom strips 8, when the bottom strips 8 are raised, they form angles with the adjacent bottom strips 8 (see FIG. 2).

When the bottom structure is lifted at the back and knee portions the plural bottom strips 8 at the bendable portions form a gentle curve. As a result, the waist, abdomen, and the underside of the patient's legs are not uncomfortably pressed by the mattress.

The plural bottom strips 8 can be standardized to be of equal size and are of simple structure. Therefore, they can be easily mass-produced which is advantageous in view of manufacturing costs.

To connect the bottom strips 8, the tenon 9 of one of the bottom strips 8 is slid, from its end, into the mortise 10 of another bottom strip 8. In this way, a predetermined number of the bottom strips 8 are connected to form the bottom portions corresponding to the bendable portions. If the shape or size of the tenons 9 and the mortises 10 and their intervals are changed, the angle of bend can be adjusted, and if the number of the bottom strips is changed, the overall length of the bottom can be adjusted.

Further, when one of the bottom strips 8 is broken during use, the broken bottom strip 8 only, can be readily changed to allow for easy maintenance.

Figure 4:
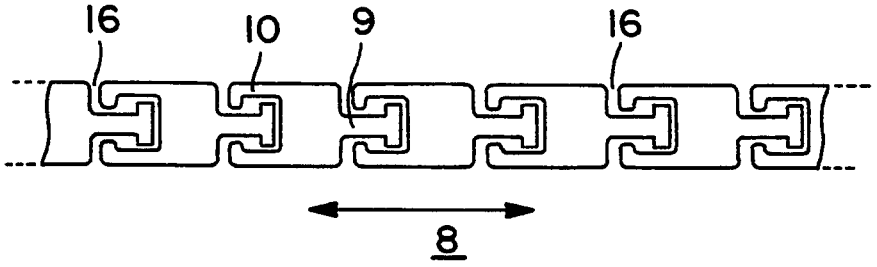
FIG. 4 is an enlarged sectional illustration showing another embodiment of the bottom strips of the present invention.

The bottom strips 8 can also be formed as shown in FIG. 4. In this case, if the tenons are formed to be longer and the mortises 10 are formed to be deeper, the bottom structure contain the bottom strips 8 can be bent and also adjusted in length in the longitudinal direction of the bed.

Figure 5:
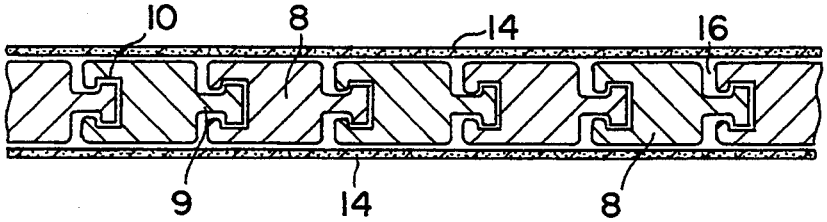
FIG. 5 is an illustration showing yet another embodiment where the entire bottom structure is covered with a flexible sheet.
Figure 6A:
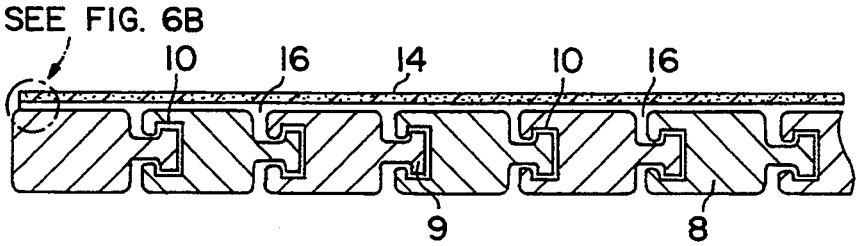
FIG. 6 is an illustration showing a further embodiment where a flexible sheet is laid on the upper surface of the bottom structure.
Figure 6B:
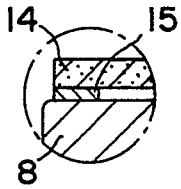
Figure 7A:
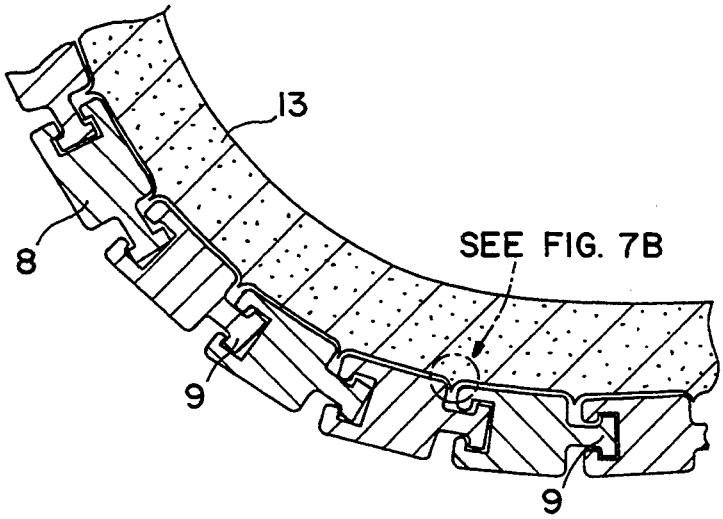
FIG. 7 is an illustration showing an embodiment where a mattress is caught in the gaps of the bottom.
Figure 7B:
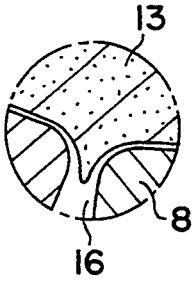

In the present invention, when the bottom structure is bent, a mattress 13 placed on the bottom structure might be caught in the gaps 16 formed between the bottom strips (see FIG. 7). To prevent this, the entire bottom may be covered with a flexible sheet 14 (see FIG. 5) or a flexible sheet 14 may be attached to the upper surface of the bottom structure (see FIG. 6).

The symbol 15 in FIG. 6 shows a means for fixing or attaching the flexible sheet 14 to the bottom structure.

Figure 2:
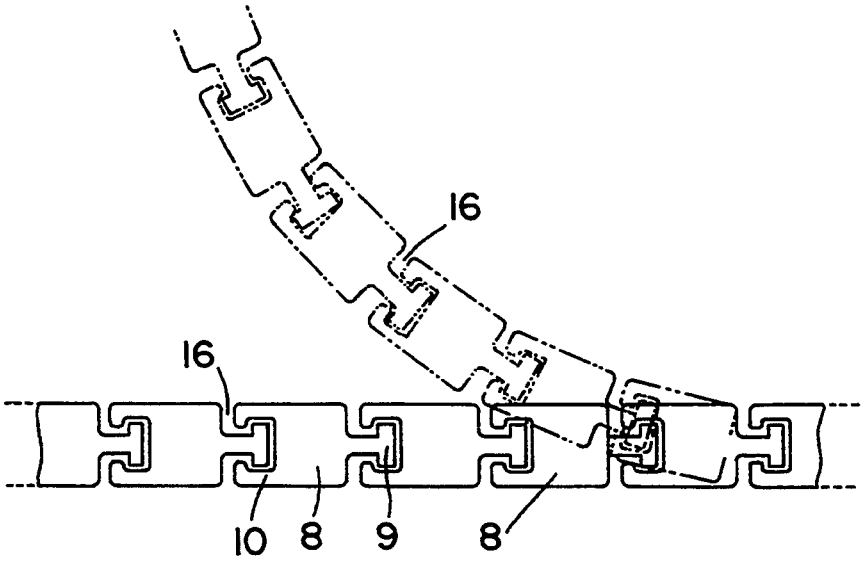
FIG. 2 is an enlarged sectional illustration showing the bottom strips at a bendable portion of the bottom structure shown in FIG. 1.
Figure 3:
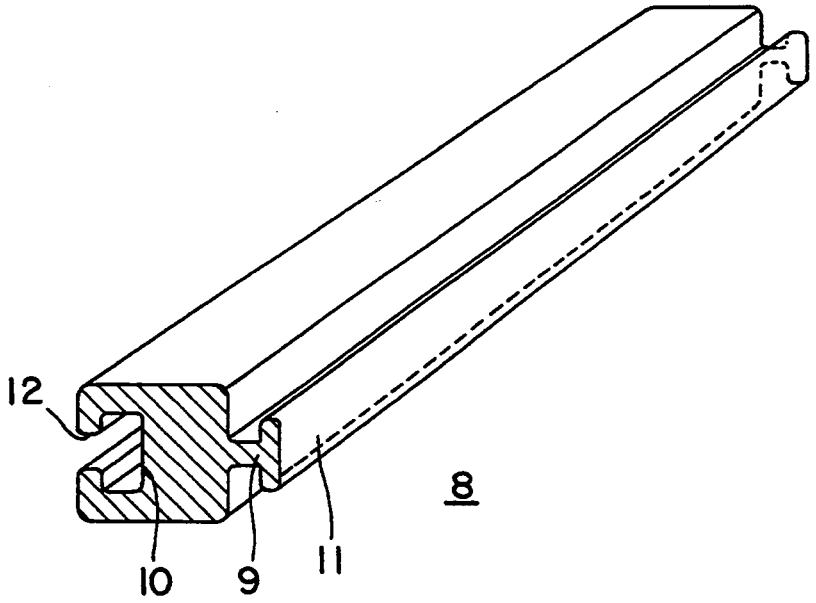
FIG. 3 is a perspective illustration of a bottom strip shown in FIG. 2.

When the bottom structures in FIG. 2 and FIG. 4 are bent, the gaps 16 formed on the upper side are pinched together. It may also happen that dust and dirt are collected in the gaps 16. However, if a flexible sheet 14 is provided, the accumulation of dust can be reduced or prevented. A flexible sheet 14 is preferably provided to permit easier cleaning. Further, it also prevents anything from being caught in the gaps formed during bending which might impair the function of the bottom structure.

As described above, the present invention has the following advantages:

1. Since plural bottom strips with the same form are connected to allow bending, the bed can have a bottom structure which can be lifted at the back and knee portions without causing any displeasing pressure.
2. Since the bottom strips are the same shape, they can be easily mass-produced with advantageous manufacturing costs.
3. If the shape and interval of the tenons and mortises of the bottom strips are changed, the angle of bend can be adjusted and the total length of the bottom structure can also be adjusted in the longitudinal direction of the bed.
4. When a flexible sheet is used to cover the bottom structure, the structure is easier to clean and materials are prevented from impeding the function of the bottom structure during bending.

What is claimed is:

1. A bottom structure for a bed with a bottom lifting mechanism comprising plural parallel bottom strips, being sequentially connected to allow bottom bending, and each of the bottom strips, having a tenon formed on one face of each bottom strip in a longitudinal axial direction of the bed, vis-a-vis with the adjacent bottom strips, and having a mortise formed on an opposite face to the face having a tenon, to be loosely engaged with the tenon of the adjacent bottom strip.

2. A bottom structure of a bed according to claim 1, wherein the tenons are formed to be sufficiently long and the mortises are formed to be sufficiently deep that the sequentially connected bottom strips may be connected more closely to each other or more widely apart from each other to allow the length of the bed in a longitudinal direction to be adjusted.

3. A bottom structure of a bed according to claim 1, further comprising a flexible sheet covering at least one surface of said bottom strips.

4. A bottom structure for a bed having a bottom lifting mechanism comprising parallel bottom strips wherein said bottom strips have at least four faces and each strip has a tenon formed on one face and a mortise formed in an opposite face of said strip and wherein said strips are sequentially connected and secured by locking engagement of said tenon of one strip with said mortise of an adjacent strip and wherein said tenon is sufficiently smaller than said mortise to facilitate movement of the tenon in said mortise and flexure between each strip such that when any section of the bed is lifted a gentle curve is formed.

5. A bottom structure according to claim 4, wherein said tenon is formed to be sufficiently long and said mortise is formed to be sufficiently deep so as allow said tenon to slide inside said mortise such that said bottom structure can be adjusted in length.

* * * * *